US005121915A

United States Patent [19]

Duncan et al.

[11] Patent Number: 5,121,915

[45] Date of Patent: Jun. 16, 1992

[54] DOCUMENT PROCESSOR HAVING IMPROVED THROUGHPUT CAPABILITIES

[75] Inventors: Michael A. Duncan; Paul A. Hakenewerth; Duane S. Miller; James C. Yarrington, all of Charlotte, N.C.

[73] Assignee: International Business Machines Corporation, Armonk, N.Y.

[21] Appl. No.: 439,958

[22] Filed: Nov. 20, 1989

[51] Int. Cl.[5] ..... B65H 3/06

[52] U.S. Cl. ..... 271/111; 271/265

[58] Field of Search ..... 271/110, 111, 265, 34

[56] References Cited

U.S. PATENT DOCUMENTS

| | | | |
|---|---|---|---|
| 4,030,722 | 6/1977 | Irvine | 271/111 X |
| 4,077,620 | 3/1978 | Frank et al. | 271/10 |
| 4,083,555 | 4/1978 | Irvine | 271/111 X |
| 4,171,130 | 10/1979 | Jeschke | 271/111 X |
| 4,331,258 | 5/1982 | Faaig | 271/270 |
| 4,331,328 | 5/1982 | Fasig | 271/270 |
| 4,357,007 | 11/1982 | Franciscus | 271/96 |
| 4,451,027 | 5/1984 | Alper | 271/10 |
| 4,541,624 | 9/1985 | Sasage et al. | 271/12 |
| 4,761,002 | 8/1988 | Reed | 271/111 |
| 4,893,804 | 1/1990 | Sasage | 271/111 X |

*Primary Examiner*—Richard A. Schacher

*Attorney, Agent, or Firm*—Kenneth A. Seaman

[57] ABSTRACT

A document processor having closed loop control of the average feeding rate of the documents and closed loop control of the gaps between documents and dynamic control of the removal of documents from the input station. By controlling the rate at which documents are introduced into the system, and the gaps between documents, more documents can be effectively read and processed in a unit of time without exceeding system limitations imposed by hardware (such as closeness of adjacent documents) even as the mechanism changes due to wear or environment.

5 Claims, 5 Drawing Sheets

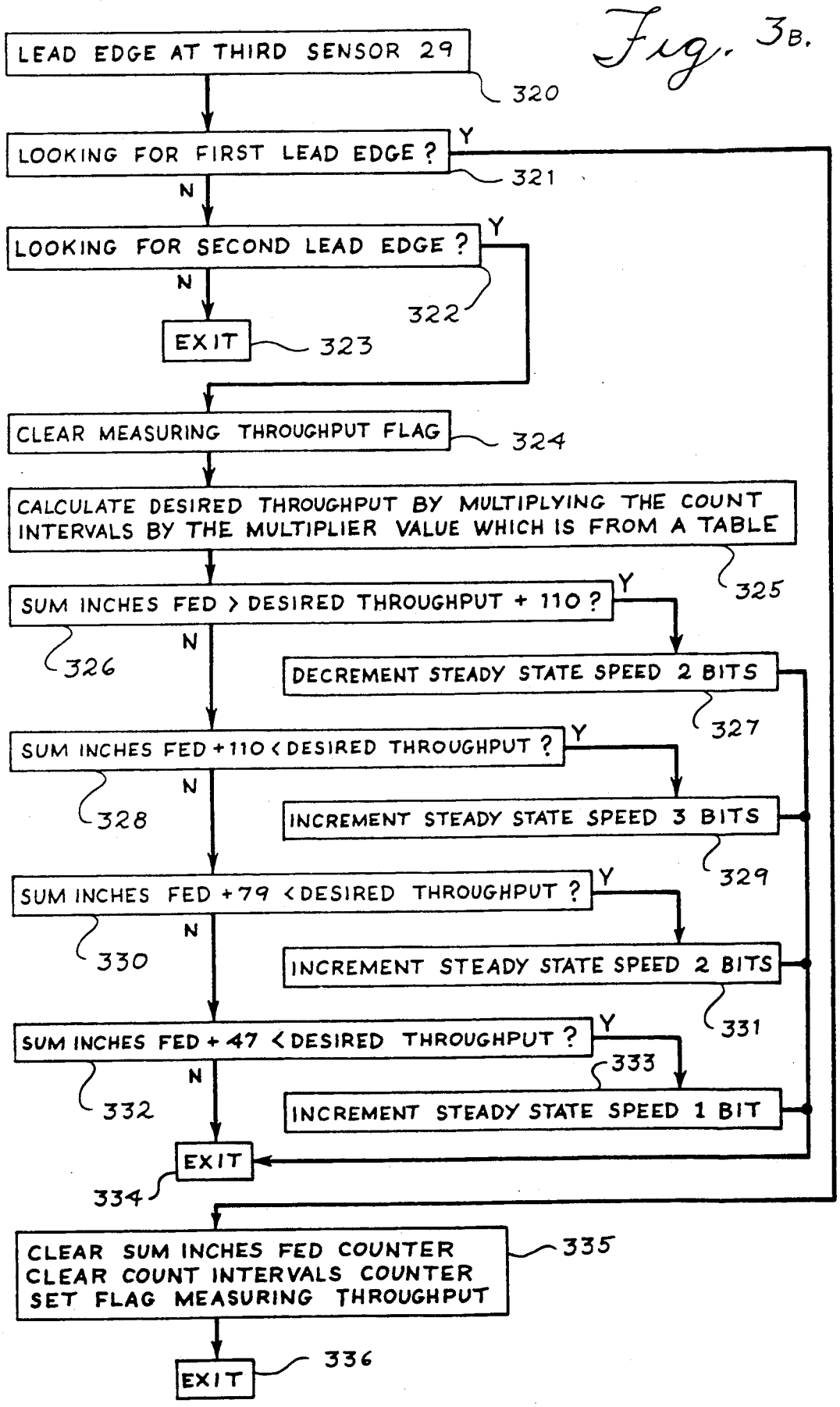
Fig. 3B.
LEAD EDGE AT THIRD SENSOR 29
320
LOOKING FOR FIRST LEAD EDGE ?
321
Y
N
LOOKING FOR SECOND LEAD EDGE ?
322
Y
N
EXIT
323
CLEAR MEASURING THROUGHPUT FLAG
324
CALCULATE DESIRED THROUGHPUT BY MULTIPLYING THE COUNT INTERVALS BY THE MULTIPLIER VALUE WHICH IS FROM A TABLE
325
SUM INCHES FED > DESIRED THROUGHPUT + 110 ?
326
Y
N
DECREMENT STEADY STATE SPEED 2 BITS
327
SUM INCHES FED + 110 < DESIRED THROUGHPUT ?
328
Y
N
INCREMENT STEADY STATE SPEED 3 BITS
329
SUM INCHES FED + 79 < DESIRED THROUGHPUT ?
330
Y
N
INCREMENT STEADY STATE SPEED 2 BITS
331
SUM INCHES FED + 47 < DESIRED THROUGHPUT ?
332
Y
N
333
INCREMENT STEADY STATE SPEED 1 BIT
EXIT
334
CLEAR SUM INCHES FED COUNTER
CLEAR COUNT INTERVALS COUNTER
SET FLAG MEASURING THROUGHPUT
335
EXIT
336

DOCUMENT PROCESSOR HAVING IMPROVED THROUGHPUT CAPABILITIES

BACKGROUND OF THE INVENTION

1. Field of the Invention

The present invention relates to document processors which read indicia on documents as the documents move from an input hopper toward a plurality of pockets, then sort each document into one of the pockets based on the indicia read. The present invention relates to improved control of the feeding of documents to achieve increased throughput.

2. Prior Art

Document processing machinery designs have a dilemma in that on one hand, high speed movement of the documents is desirable, but, on the other hand, the equipment has limitations in how fast it can operate. For example, the electromechanical gates which open and close to direct one document into a selected pocket, can only operate so quickly within the interdocument gap. If the documents are fed at a higher rate, a shortened gap will result causing errors to occur, such as improper sorting or failure to sort.

Increasing document transport speed will increase document gap but can result in document damage as well as processing and stacker errors.

Further complicating the design is that components involved with the feeding of documents rely on mechanical friction using components which wear and are influenced by environmental factors such as temperature and humidity.

One way to approach these design constraints is simply to choose an operating point which is sufficient to allow for wear and environmental concerns. While this can be effective, it implies some sacrifice of potential performance.

Another way to compensate for such variable factors is to attempt to keep the gap between documents relatively constant.

Examples of such prior art systems include U.S. Pat. Nos. 4,451,027 and 4,331,328.

The referenced prior art is limited in performance by the inertia of the plurality of rollers accelerated. This means that a high amount of power may be required and excessive heat may be generated, both of which are undesirable.

Other limitations and disadvantages of prior art systems are apparent to those skilled in the art of document processor control systems.

SUMMARY OF THE INVENTION

The present invention overcomes the disadvantages and limitations of the prior art document processors. This invention provides a means to optimize the creation of natural gaps by a friction separator and avoid shorter-than-acceptable gaps by varying the speed of the feed wheel (also referred to as a feed tire) when potentially short gaps (unacceptable for proper sorting) are detected. The present invention also allows the feed rate of document processor to be set high during optimum processing without having failures under less than ideal conditions.

The present invention also allows compensation for wear of the mechanical elements and for changes in the environmental factors, maintaining desired throughput.

Other objects and advantages of the present invention will be apparent to those skilled in the art, in view of the following description of the invention, the appended claims and the accompanying drawings.

DETAILED DESCRIPTION OF PREFERRED EMBODIMENT

Figure 1:
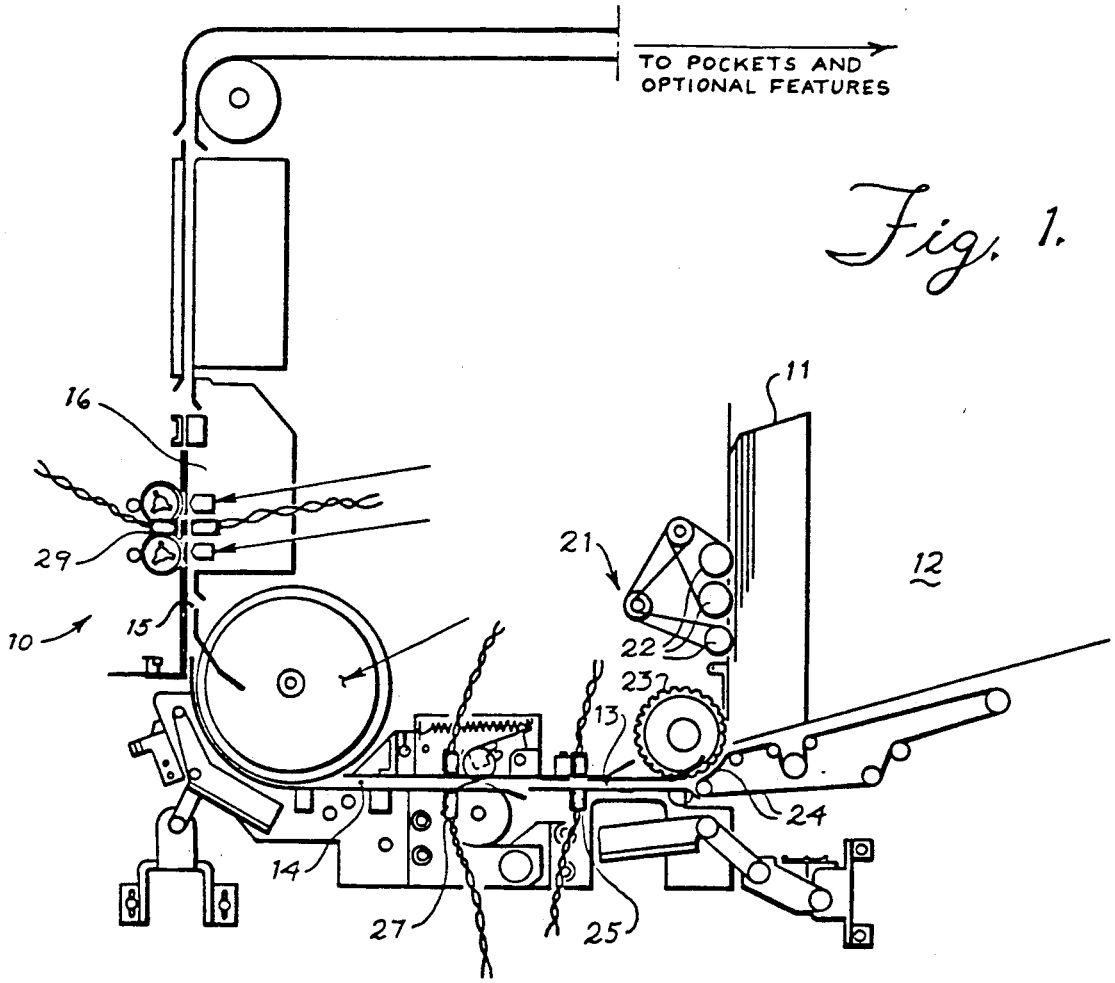
FIG. 1 is a view of a portion of the document processor of the present invention.

FIG. 1 shows a partial cut-away view of a document sorter 10 of the present invention. The document sorter 10 takes checks or other documents 11 from a hopper 12 and moves them along a feed path generally shown by the reference numerals 13. 14. 15. 16 and 17. Individual checks are carried along the feed path one at a time past various sensors and readers, some of which will be described later, then past optional features such as a microfilm camera and an item numbering device to a plurality of pockets. The microfilm camera, the item numbering device and the plurality of pockets are not shown in this view, in part because they are conventional and well known, and reference could be made to either an IBM Model 3892 Document Processor or its associated documentation for further details of their construction and operation. The Guide To Operations and the Service Manual for the IBM Model 3892 Document Processor are specifically incorporated herein by reference for the details of the individual elements of a conventional document processor, microfilm camera, item numbering device and pocket selection mechanism, as well as a standard MICR and OCR reading techniques and apparatus. All of these items are generally well known in the art and form only the background against which the present invention is related.

Adjacent the hopper 12 is a picker assembly 21 including a plurality of live rollers 22. A feed tire 23 is positioned below the picker assembly 21 and adjacent to hopper 12. The picker assembly 21 moves a single document from the hopper 12 into a nip formed by the feed tire 23 and a restraint belt 24. The feed tire 23 then serves to advance a single document along the portion of the document feed path referred to by the reference numeral 13.

Along this feed path 13 is a first sensor 25 which is located approximately 2.5 inches inwardly from the feed tire 23. This first sensor 25 senses the presence or absence of a document adjacent to it in the feed path 13. Since this sensor is located only approximately 2.5 inches along the feed path from the feed tire 23, and the typical document has a length of 6 inches, the leading edge of that document will be passing the first sensor 25 while the feed tire is engaging the middle portion of the same document. Accordingly, if the feed sensor senses that a document is too close to the preceding document the separator servo driver 47 can immediately stop or reduce the speed of the feed tire 23, the distance between the current document and the previous document can be increased, after which the speed of the feed tire is rapidly increased to its original value.

A second sensor 27 is located approximately 2.00 inches further along the document feed path from the first sensor 25. This second sensor monitors the presence of gaps between the first check and a second check. Since the feed path to the left of the first sensor operates faster than the feed tire 23 feeds the documents. the leading document carried by the faster belt in the region of the second sensor has a tendency to pull away from and develop a widening gap with respect to a second document which is in the region of the first sensor and being driven by the feed tire 23. Accordingly. it is possible that the second sensor 27 will see a gap where the first sensor 25 did not, indicating that the documents were overlapped at the time they passed the first sensor 25 and that the feed tire should be slowed rapidly to develop a gap between the first and second checks.

It should be understood that the hardware involved in the document processor has a predetermined reaction period. That is, the time necessary to select or gate a document into a given pocket requires that there be a gap of a predetermined or preset time period between a first document and a second document. If that preset gap or period of time between two adjacent documents is not present, then the pocket selection mechanism may not be reliable in selecting the right pocket for the document. Accordingly, if the time period or gap between two adjacent documents is not equal to or greater than a preset period (in this case 10 milliseconds). then the machine is programmed not to consider either document and to place them into a reject pocket indicating that the documents were either unreadable or unprocessable.

It should also be understood that the feed tire 23 is made of a rubber component and is subject to wear and other aging type problems. The feed tire 23 is also subject to environmental factors, namely those depending on the temperature and humidity, and friction. Its ability to move a document from a stack is either increased or decreased, based upon these conditions or variables. Even a small change in the size of this feed tire 23 can be a significant variation in the speed at which a document is moved forward for feeding.

A third sensor 29 is positioned farther along the feed path 15. This third sensor 29 is positioned in the region where MICR reading is occurring, although it may be located almost anywhere along the path. This third sensor 29 is responsive to the rate at which paper passes, that is, whether the sensor is covered by paper or not covered by paper, to produce an indication of the duty cycle or period of time during which paper is passing the sensor. That is, the higher the percentage of time that the third sensor 29 is covered by paper, the greater the length of the documents passing compared to the interdocument gaps where no paper is passing. Since the transport at this point is running documents at a relatively constant speed of approximately 265 inches per second, it is desirable to regulate the approximate number of inches fed by the feed tire 23 per second or per minute to provide a relatively constant feed rate. This has been referred to as the "sum inches fed" per period of time, which has meaning when looked at over a long period, such as a full second. In order to maintain a nominal processing rate of 1700 documents per minute for six inch documents, this implies that approximately 10.200 inches per minute of paper must be passing the MICR read head or 170 inches per second passing at the sensor 29. This implies that a duty cycle or percentage of paper compared to a percentage total of approximately 65 percent would be adequate. If, for example, the sensor is covered at less than that level, it is because the feed tire 23 is not feeding documents rapidly enough to put them in the transport and therefore the speed of the feed tire 23 and thus the rate of its feeding should be increased. If the coverage is greater than 65%, then documents are being fed at too high a rate and the feed rate must be reduced.

Figure 2:
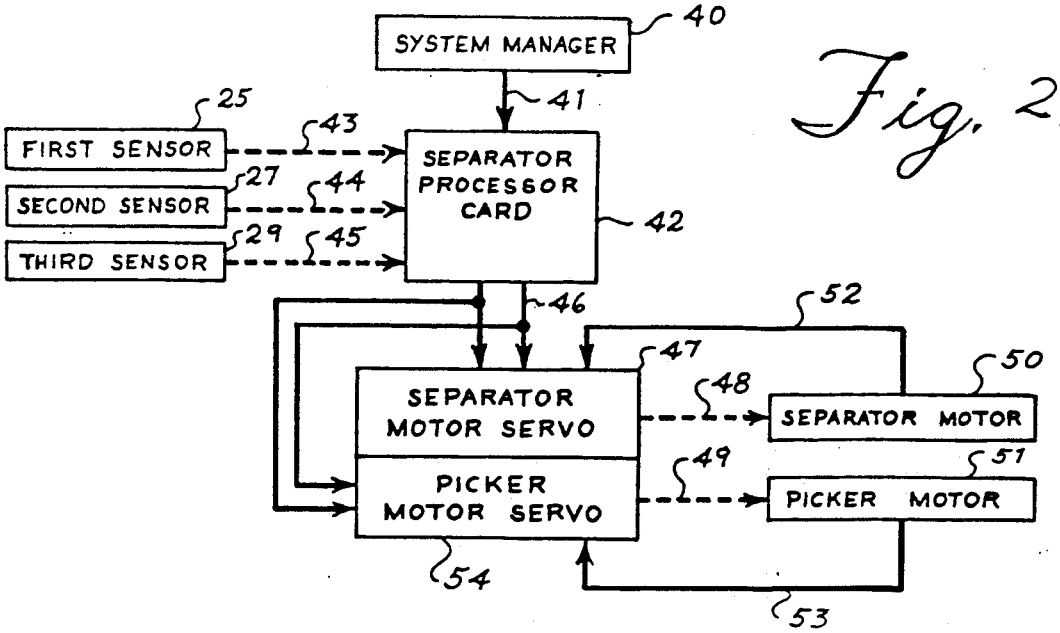
FIG. 2 is a block diagram of the control system of the present invention.

FIG. 2 illustrates a block diagram of the control system of the present invention. As depicted here, a system manager 40 provides instructions and control on lines 41 to a separator processor card 42. The system manager may be a special purpose hardware controller built with conventional logic and sequencing hardware or it may be a microprocessor with a set of stored programs as desired. Similarly, the separator processor card 42 (so called because its main function is to control the separator feeding documents) may be a hard-wired controller, a programmable controller or a microprocessor as desired.

The separator processor card 42 receives inputs from the first sensor 25, the second sensor 27 and the third sensor 29 along the line 43, 44, 45, respectively, and performs logic as described elsewhere in this patent.

The output from the separator processor card 42 which is a velocity command is on bus 46 to two servos, one each for the separator motor and the picker motor in blocks 47 and 54, which control via lines 48, 49 the separator motor 50 and the picker motor 51, respectively. Of course, the separator motor 50 controls the feeder tire 23 (in FIG. 1) and the picker motor 51 controls the picker assembly 21 and associated live rollers 22 in FIG. 1. Velocity feedback from the separator and picker motors to their respective servos 47 and 54 is used to regulate motor velocities accurately to the velocity command from the processor 42.

Figure 3A:
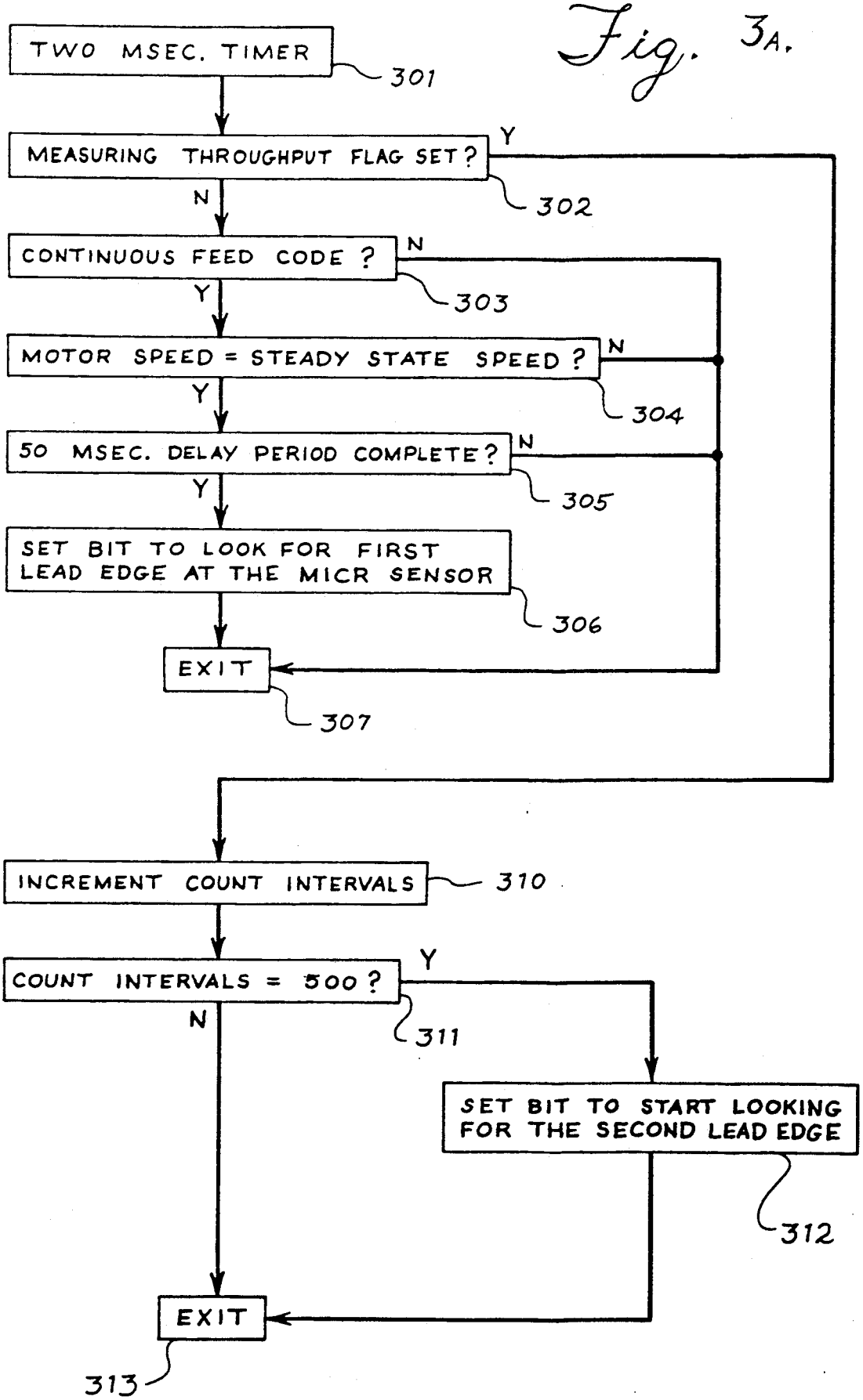
FIG. 3 (consisting of FIGS. 3A, 3B, 3C) is a flow chart showing the logic for throughput control.
Figure 3C:
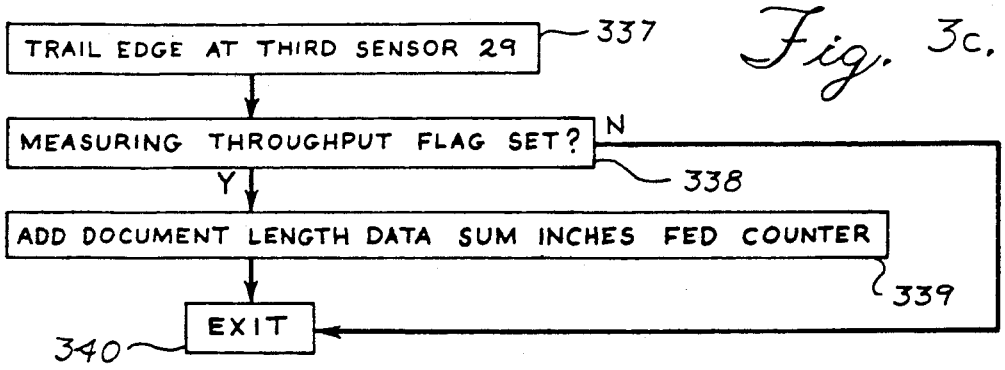

FIG. 3 (consisting of FIGS. 3A. 3B and 3C) illustrates the logic steps that control the throughput, or number of processed documents. using the third sensor 29 in FIG. 1.

Figure 4:
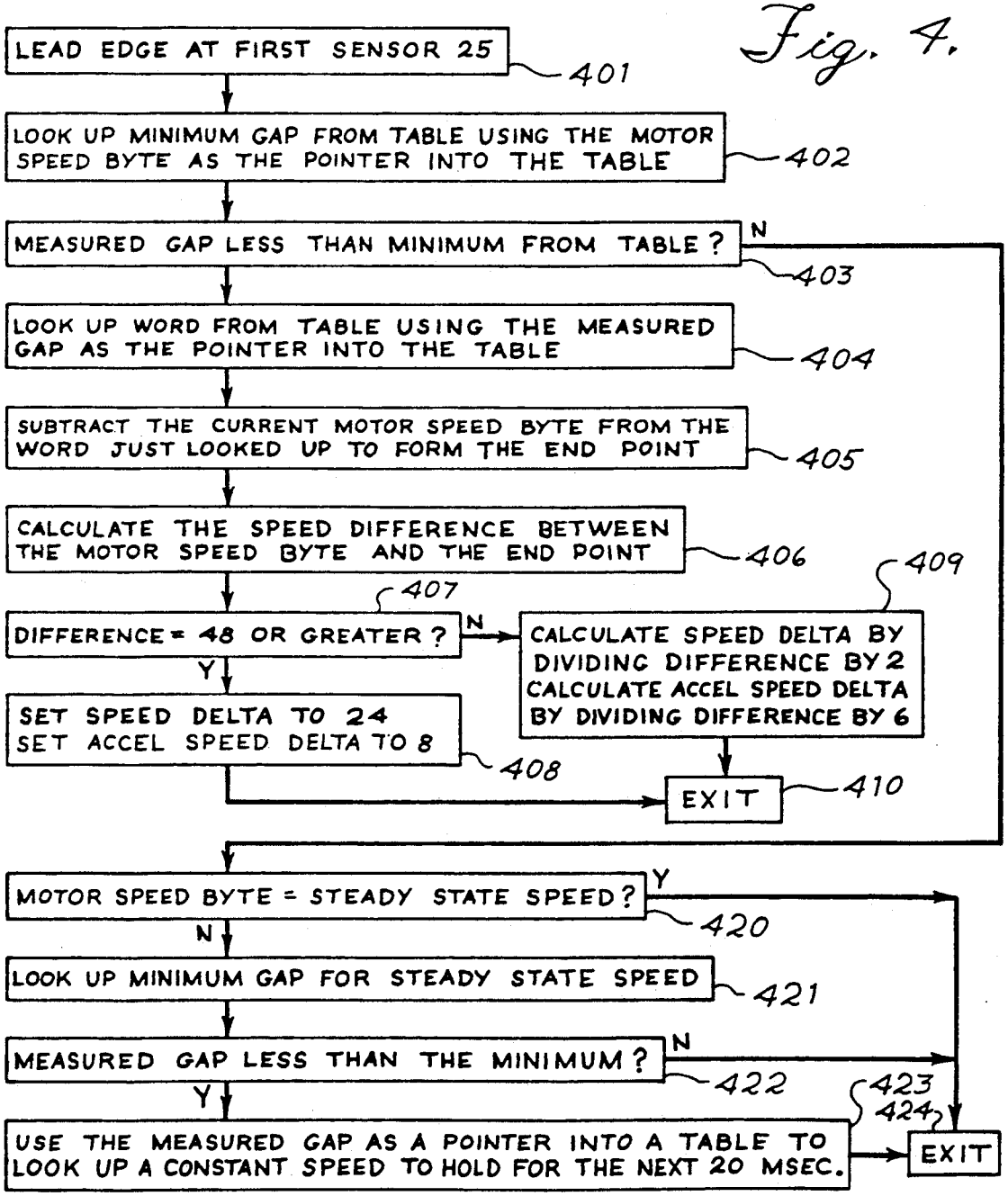
FIG. 4 is a flow chart of the logic for one type of gap control.
Figure 5:
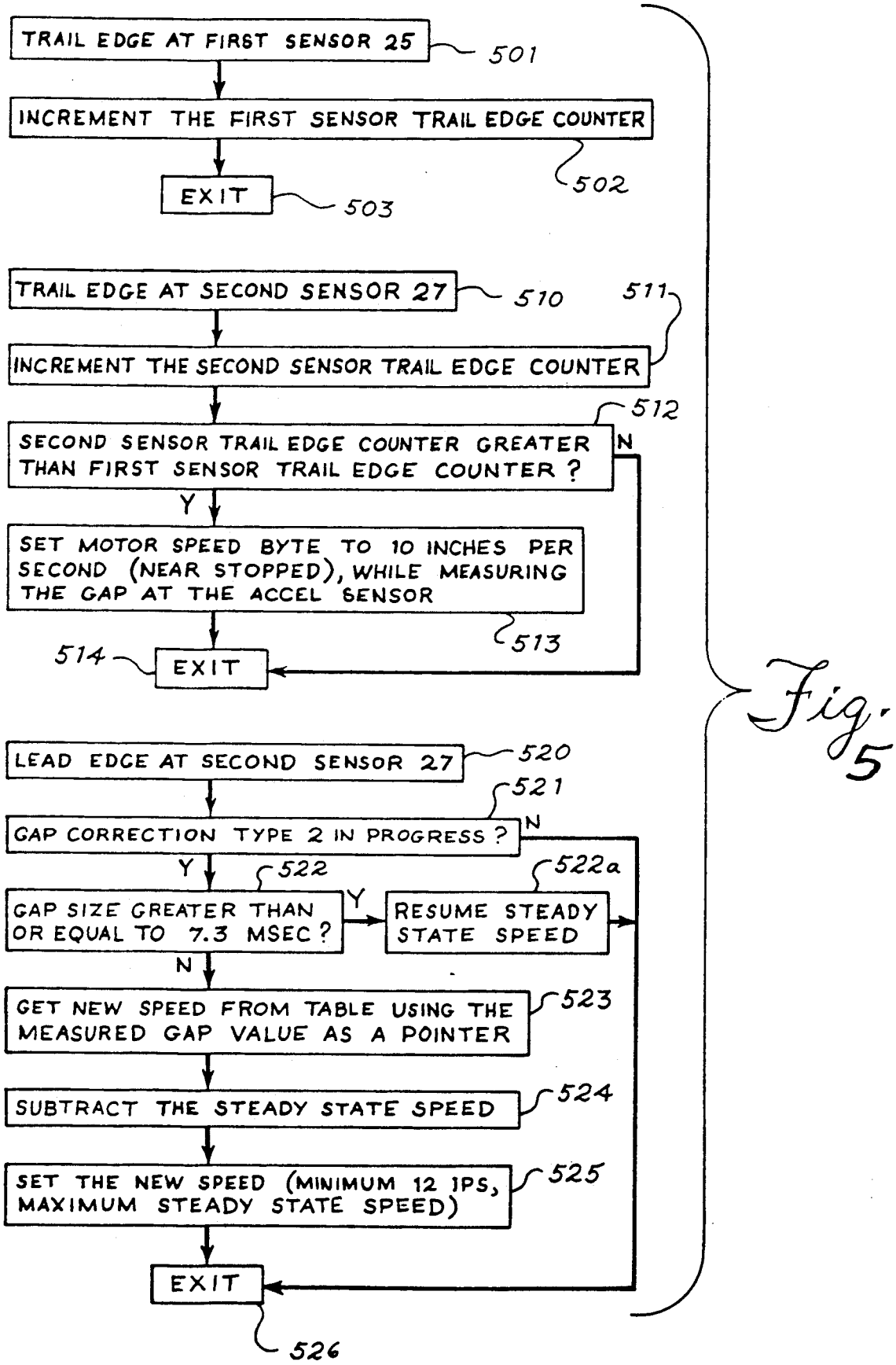
FIG. 5 is a flow chart of the logic of the second type of gap control.

FIGS. 3-5 illustrate logic flow diagrams which in most cases are self-explanatory. In keeping with conventional flow diagram techniques, where a question (or test) exists in a block, (such as block 302), if the answer is "Yes", control follows the branch with the "Y" (in this case to block 310) and if the answer is "No", then control follows the branch, with the "N" (in this case to block 303).

FIG. 3 collectively controls the speed of document handling and the gaps between documents by sensing the amount of paper passing the third sensor 29 in a fixed period of time. It is assumed that the documents are being moved past the third sensor at a fixed speed of approximately 265 inches per second.

As illustrated, this system employs a 2 millisecond timer in block 301 to keep track of real time. Another timer loop samples all three sensors 25. 27 and 29 and sets flags accordingly when document lead edge and trail edges are detected. This timer loop samples the sensors every 0.1 m seconds. So, at block 302, the system tests whether measuring throughput is in progress and if so, increments the count intervals at block 310. If throughput is currently not being measured and the separator motor is in continuous feed mode at block 303 at the STEADY-STATE-SPEED at block 304, and a 50 millisecond delay has elapsed at block 305, then the throughput measurement is restarted by setting the flag LOOKING-FOR-FIRST-LEAD-EDGE at block 306. Whenever lead edge at sensor 29 occurs the code at block 320 is executed. If the flag FIRST-LEAD-EDGE is set at block 321 then the two counters which are used to calculate the percentage of paper feed are zeroed and the flag MEASURING-THROUGHPUT is set at block 335. This causes the TWO-MSEC-TIMER routine to increment the COUNT-INTERVALS while measuring throughput flag is set at block 310. Each document time is added to the sum-inches-fed counter when the trail edge is detected at sensor 29 at block 339. This continues until the count intervals reaches 500 at block 311. Then a flag "SECOND-LEAD-EDGE" is set at block 312 to look for the next lead edge at sensor 29. When this "SECOND-LEAD-EDGE" is detected at block 322, the throughput measurement interval is over and the count intervals is multiplied by a constant to arrive at the desired value of SUM-INCHES-FED at block 325. The algorithm then compares the measured value to the desired value and adjusts the motor speed accordingly to move the throughput toward the desired value at blocks 326 through 333.

By judicious choice of the TWO-MSEC-TIMER repetition rate and the integer multiplier used in block 325, any throughput may be operated at.

FIG. 4 illustrates a logic diagram for a first type of gap control in feeding documents from the hopper 12 to the feed path 13 . . . of the document processor 10 of the present invention. This logic is advantageously carried out in the separator processor card 42 described in connection with FIG. 2. The objective of the logic of FIG. 4 is to determine when a second document is too close to a first document and slow the feed tire 23 while the second document is still being driven by it.

FIG. 5 illustrates a logic diagram for a second type of gap control in feeding documents from the hopper 12 of the present invention. Again, this logic is advantageously carried out in the separator processor card 42 described in connection with FIG. 2. The objective of the logic of FIG. 5 is to determine when the second sensor 27 sees a gap which the first sensor 25 failed to see (because two documents were overlapped when they passed the first sensor but a small gap appeared when the first accelerates before the second, forming a gap) and to cause the transport feeding mechanism (the feed tire 23) to slow down substantially to reduce the chance of further overlapped documents in feeding and to attempt to correct the overlap at the first sensor 25.

Document feed rate is specified as the number of documents of a given length (generally 6 inches) processed per unit time. The system employed can accurately adjust to the desired rate regardless of the length of documents being fed—that is, a feed rate and gap can be specified for nominal six inch documents and the system of the present invention can be adjusted even without any six inch documents being present.

Of course, many modifications to the preferred embodiment described previously are possible without departing from the spirit of the present invention. For example, there are many different ways to provide the closed loop feedback described in the present invention, and it is not limited to the particular types of sensors or the particular types of controls. As a further example, the feedback control in its preferred embodiment is described as a software algorithm. However, it is well known that the same functions can be accomplished through the use of hardware mechanisms. Additionally, some features of the present invention can be used to advantage without the corresponding use of other features. Accordingly, the description of the preferred embodiment should be considered as merely illustrative of the principles of the present invention and not in limitation thereof.

Having thus described the invention, what is claimed as our invention is:

1. A document processing apparatus for moving documents from an input hopper to a destination at a high speed comprising:

means for moving each document from the input hopper to the destination, said means including a friction drive wheel member coupled to a first motor for moving each document from the input hopper;

first means for sensing the gap between a first document and a succeeding document while the succeeding document remains driven by the friction drive:

means for sensing that a gap between the first document and the succeeding document is less than a preset value;

means for adjusting the friction drive wheel speed while the succeeding document is still being driven by it to increase the gap between the first document and the succeeding document; and second means for sensing a gap between two documents where said first means for sensing a gap failed to sense a gap, said second means also causing an adjustment of the friction drive wheel speed.

2. A document processing apparatus of the type described in claim 1 wherein the means for adjusting includes a stored program with a representation of the desired feed wheel speed and gap between documents stored.

3. A document processing system of the type described in claim 1 wherein the second means includes means for making a large temporary decrease in the speed of the friction drive wheel.

4. A method of processing documents by moving the documents from an input hopper to the destination at a controlled rate, the steps of the method comprising:

moving the documents from the input hopper to the destination including the step of driving a document into a feed path from the input hopper at an adjustable time period after a previous document had been fed;

sensing distance between that document and a following document at two different locations and sensing at a third location the ratio of the time during which a document is passing the third location to sum of the time during which a document is passing that third location and the time during which no document is passing the third location;

adjusting the adjustable time period between driving of succeeding documents to achieve a desired relationship between the document feed rate and said ratio.

5. A method including the steps of claim 4 wherein the step of adjusting is achieved by storing a value representing the instantaneous duty cycle and gap;

comparing the stored duty cycle and gap to stored values representative of the desired duty cycle and gap; and adjusting the adjustable time period for driving the document from the hopper into the feed path to adjust the duty cycle and speed as necessary, whereby the number of documents passing through the system in a unit of time may be controlled and maximized.

* * * * *